US005465812A

United States Patent [19]

Petter

[11] Patent Number: 5,465,812

[45] Date of Patent: Nov. 14, 1995

[54] PALLET GUARD

[75] Inventor: Jay C. Petter, Pentwater, Mich.

[73] Assignee: Pentwater Wire Products, Inc., Pentwater, Mich.

[21] Appl. No.: 251,608

[22] Filed: May 31, 1994

[51] Int. Cl.[6] ..... B66B 9/20

[52] U.S. Cl. ..... 187/237; 414/785

[58] Field of Search ..... 187/222, 237; 414/785, 629, 630, 631

[56] References Cited

U.S. PATENT DOCUMENTS 4,747,610 5/1988 Yingling ..... 414/785

4,904,147 2/1990 Wasylyshyn ..... 414/785

5,220,980 6/1993 Petter ..... 187/9

5,279,405 1/1994 Petter ..... 187/9

*Primary Examiner*—Kenneth Noland

*Attorney, Agent, or Firm*—Price, Heneveld, Cooper, DeWitt & Litton

[57] ABSTRACT

Pallet guards to interfit with opposite ends of a pallet, each guard comprising a restraining panel and a plurality of short depending feet to interengage the pallet and restrain the guard in upright position on the respective end of the pallet against movement outwardly of the pallet. Preferably, the guards can be rotated between the upright restraining position and horizontal compact position on top of an empty pallet for storage.

33 Claims, 7 Drawing Sheets

PALLET GUARD

BACKGROUND OF THE INVENTION

This invention relates to pallet guards for restraining items from tumbling off a pallet during movement by a lift truck and/or as items in cartons may tend to settle and shift while stored.

Pallets are used by the hundreds of thousands in industry to store and transport a multitude of products or other work items. Often the storage racks are several pallet tiers high. During movement thereof by the typical lift truck, abrupt starts or stops can cause the articles to topple off the pallet toward the lift truck operator. Further, when stacked cartons of goods on the pallets become weakened due to moisture absorption or other factors, the weight of top cartons can cause the stack to settle and lower cartons to be compressed unevenly, thereby tilting the stack, allowing some cartons to potentially slide off. Previously, banding of goods on pallets has been used to limit this type of occurrence. Also, special nets have been provided in front of storage racks to limit this type of occurrence. Finally, pallet guards have previously been designed as set forth in U.S. Pat. No. 5,220,980 and U.S. Pat. No. 5,279,405 for attachment to individual wood pallets to prevent the goods from dropping into the aisles or onto the lift truck operator. These pallet guards have been found to work effectively.

Prior guards in the above-noted patents, however, can be used for only one end of the pallet since the legs thereof extend through the pallet to the opposite end of the pallet for secure attachment to the pallet. There is little room to place a second guard on this opposite end extending back in the first direction, i.e., toward the lift truck end. Hence, although prior guards prevented items from toppling off the pallet in one direction, i.e, toward the lift truck or into the aisle, rapid initial movement of a reversing lift truck moving a pallet full of items from storage could cause items to fall off the back end of the pallet. Moreover, crushing of cartons could allow the top cartons to slide off the rear end of the pallet. These spills tend to damage the falling items, and/or other items struck by them, and/or the storage racks themselves, as well as being potentially dangerous and presenting costly pickup problems for the fallen goods. This is a problem.

Additionally, the increasing use of pallets molded of polymeric materials and of different design from the typical wooden pallet often prevents even these guards from being attached.

Another complication occurring with these prior pallet guard models occurs when the pallets are empty and must be returned. If the pallet guards are left in place, the pallets cannot be conveniently stacked for shipment. When the pallet guards are removed from the pallets, the pallets are then stackable, but there is no way of easily stacking the L-shaped pallet guards for return transport.

SUMMARY OF THE INVENTION

One object of this invention is to provide a unique pallet guard configurated in the form of a structure capable of placement on both the front and rear ends of the pallet, as well as either the front end of the pallet or the rear end of the pallet, so as to protect items on the pallet from falling in either direction, either forward or backward. The novel pallet guard can be installed quickly and easily on both ends of the pallet.

Another object of this invention is to provide a novel pallet guard which can interfit with polymeric pallets on the market today. Optionally, the guard units can be installed on the exterior of the pallets or in recesses in the pallets. The novel pallet guard is preferably pivoted to a compact condition on the pallet, and capable of being reverse rotated to upright operative position from a lowered storage position parallel to the pallet. The empty pallets and guards can be shipped together and in compact condition. If desired, the polymeric pallets can be formed to have an underside cavity to receive lowered pallet guards therebelow, and thereby cause horizontal pallet guards on pallets therebeneath to interfit therein in such a fashion that the pallets will stackingly rest on each other rather than on the stored pallet guards between them.

Preferably, pallet guards on both ends of a pallet can both be pivoted down to a storage position on the pallet.

These and several other objects of this invention will become apparent upon studying the following specification in conjunction with the drawings.

DESCRIPTION OF THE PREFERRED EMBODIMENTS

Figure 2:
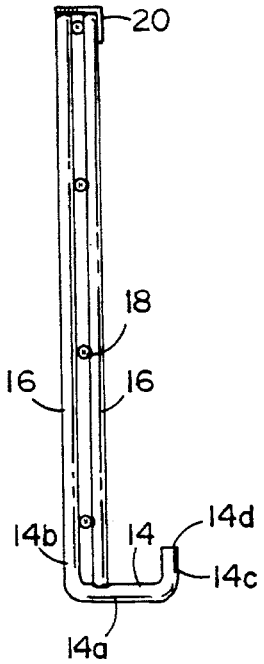
FIG. 2 is an end elevational view of the pallet guard in FIG. 1.

Referring now specifically to the drawings, the first embodiment pallet guard 10 there depicted is shown to include an upright panel subassembly 12 and a plurality of three like feet 14 projecting downwardly from panel 12. This panel is preferably made up of a plurality of elongated members secured together to form a generally planar arrangement. These elements are preferably of metal, i.e., wire or rod, e.g., one-half inch in diameter, and shown here to include a plurality of spaced, parallel, upright rods 16 interconnected to each other by a plurality of vertically spaced, horizontal, parallel rods 18. The interconnection between these metal members is preferably by welding. As depicted in FIG. 2, the vertical members 16 can be in pairs straddling the horizontal members 18, for extra strength. They provide extra strength in the event the pallet loads weigh several thousand pounds. This double vertical arrangement need not be used in situations where the pallet loads are relatively lightweight. At the top of the panel is shown a piece of angle iron 20 extending horizontally and attached to the top edge of rods 16 to add rigidity to the guard. At the lower end of panel 12 is the plurality of feet 14, here shown to be three in number and U-shaped, formed from an integral part of the lower ends of vertical rods 16. More specifically, these feet include a bottom support surface on the horizontal cross leg **14*a* of the U-shaped feet. One vertical leg 14*b* of these U-shaped feet comprises a vertical downward extension of rods 16, while the other outer leg 14*c* of the U-shaped feet has a top abutment surface 14*d* on its terminal end. These three abutment surfaces 14*d*** of the three feet engage the pallet in a special manner to be described hereinafter. There are many variations possible for this panel including solid metal, plastic or wood, a screen and frame, or others.

Figure 1:
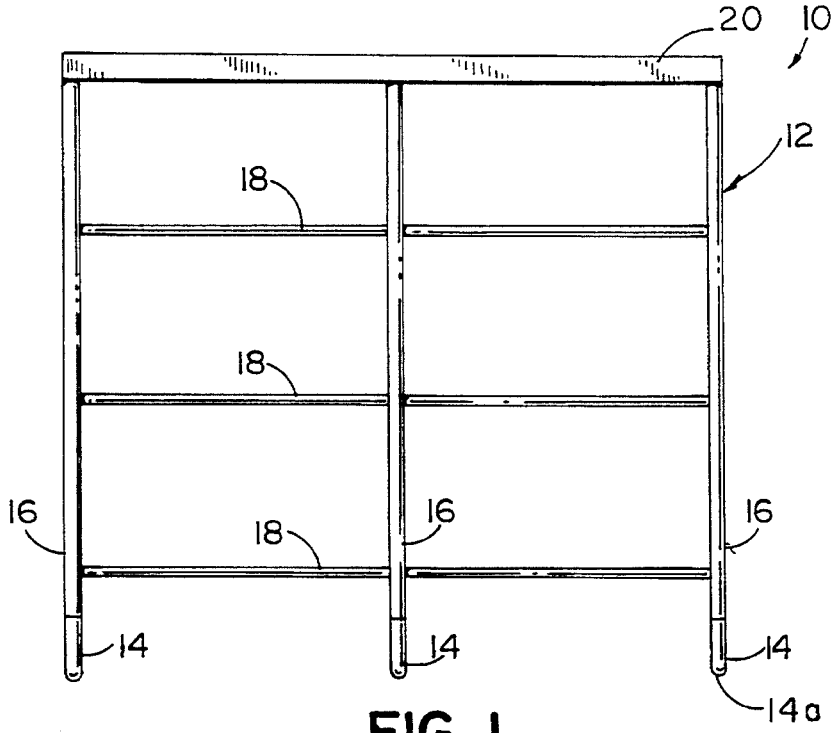
FIG. 1 is front elevational view of one embodiment of the novel pallet guard.
Figure 3:
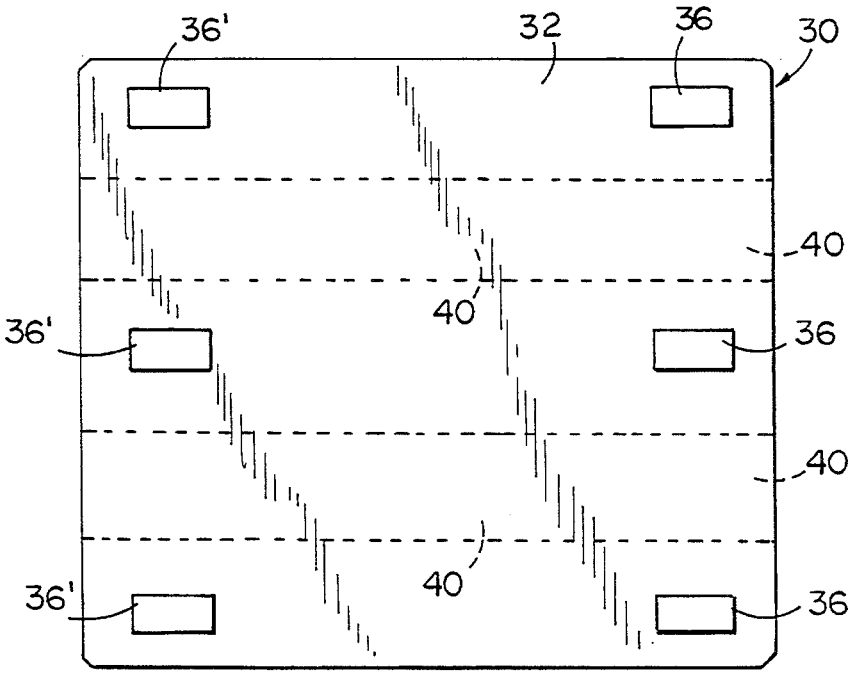
FIG. 3 is a plan view of a typical polymeric pallet of the type shown in combination with the first embodiment pallet guard in FIGS. 1 and 2.
Figure 4:
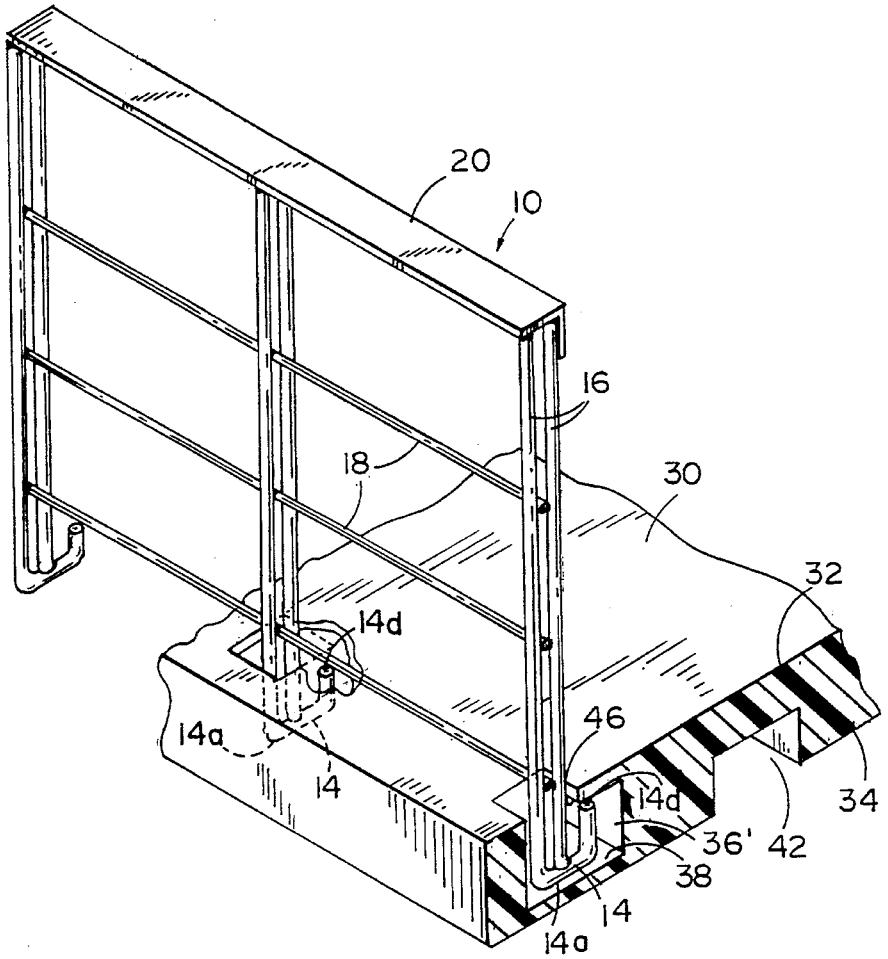
FIG. 4 is a fragmentary, isometric view of the first embodiment pallet guard and a small portion of the polymeric pallet, showing the interfit therebetween.
Figure 5:
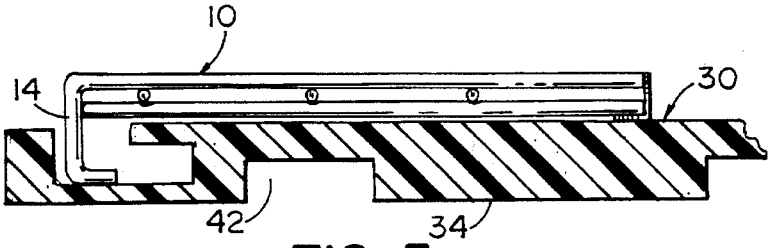
FIG. 5 is a side elevational, fragmentary view of the pallet showing the first embodiment pallet guard in the lowered, at-rest, stored position.

This pallet guard specially interfits with polymeric pallets, an example of which is shown in FIGS. 3, 4 and 5, having top openings. Typically, pallet 30 of the type shown is made of a polymeric material, and has a thickness of several inches between its upper support surface 32 and its lower support surface 34. Such pallets are often molded of a grid type structure rather than solid from top to bottom, to save material and for other reasons. A simplified version is here depicted for purposes of clarity. The pallet includes a pair of lower elongated slots 40 extending from the front to the rear thereof (FIG. 3) below the top surface, for normal entry of a pair of tines of a lift truck. The bottom surface 34 of the pallet also normally includes a pair of laterally extending slots 42 therein for occasional potential receipt of lift truck tines from the sides of the pallet. Either or both of the lift truck receiving slots 40 and 42 may be open to the bottom of the pallet as shown by slots 42, or may be lateral openings spaced above the bottom surface and below the top surface.

The pallet has a plurality of top openings and pockets, e.g., three, in each end, i.e., three in the forward end and three in the rearward end. The openings in the forward end are here indicated as 36 and those in the rearward end as 36'. These openings extend into and normal to the top surface 32 to form the pockets which are preferably blind on the lower end, i.e., have a bottom closure and support surface 38. Optionally, the bottom support surface 38 can only partially cover the opening at the bottom so as to allow drainage of water or the like therefrom. These openings cooperate with the feet 14 of guard 10 as explained hereinafter. At each of the openings 36 and 36' is a downwardly oriented stop surface 46, preferably formed by an overlying edge of the pallet, for engagement by the upwardly oriented abutment surfaces **14*d* (FIG. 4) of the upright pallet guard. Thus, any tendency to force vertical panel 12 outwardly of pallet 30 will be resisted by a combination of the engagement of bottom support 14*a* of feet 14 with bottom 38 and engagement of abutment surfaces 14*d* with the downwardly oriented stop surfaces 46. This interengagement between the guard panel and the pallet stabilizes loads on the pallet. The depth of the openings or pockets 36, i.e., between bottom 38 and stop surface 46, is substantially equal to the height of legs 14*d* of feet 14. As can be readily seen, like guards can be placed at both the front and rear ends of the pallet, thereby preventing spillage of the load from the pallet at either the front end or the rear end. Hence, load shifting and spilling forwardly or rearwardly with rapid starting or stopping of a lift truck hauling pallet 30** and its load is restrained. Further, deteriorating or crushed stacked cartons on the pallet will also be prevented from spilling forwardly or rearwardly. The height of the guard can be preselected, i.e., varied, depending on what is needed for the particular products and use involved.

The horizontal length of leg **14*a*, i.e., the spacing between legs 14*b* and 14*c* of feet 14, is greater than the length of openings 36 or 36' in that dimension, i.e., direction. The length of leg 14*c*, however, is less than the length of openings 36 or 36' in that dimension. Therefore, the guard can be secured to or removed from the pallet as explained below. The extension of leg 14*c* beneath the overlying edge 46 when the guard is installed and upright also prevents the guard from being bounced up out of openings or pockets 36** if the lift truck hits a bump.

FIG. 5 depicts the guard in its horizontal at-rest position on top of and parallel to the pallet. Installation of the guard 10 with either end of the pallet is initiated by placing the guard in this relationship, i.e., with feet 14 extending down into openings 36 or 36' and the guard lying on the upper surface of pallet 30. The guard is then rotated upwardly toward the outer front or rear edge of the pallet to the upright position illustrated in FIG. 4. The second guard is installed at the opposite end of the pallet in the same fashion, in mirror image thereto. Disconnection of a guard from the pallet is accomplished by reverse movement of the vertical panel to the horizontal orientation illustrated in FIG. 5, and lifting it. If desired, the guard and pallet can be shipped in this compact condition back to the company which loads the pallets.

Figure 6:
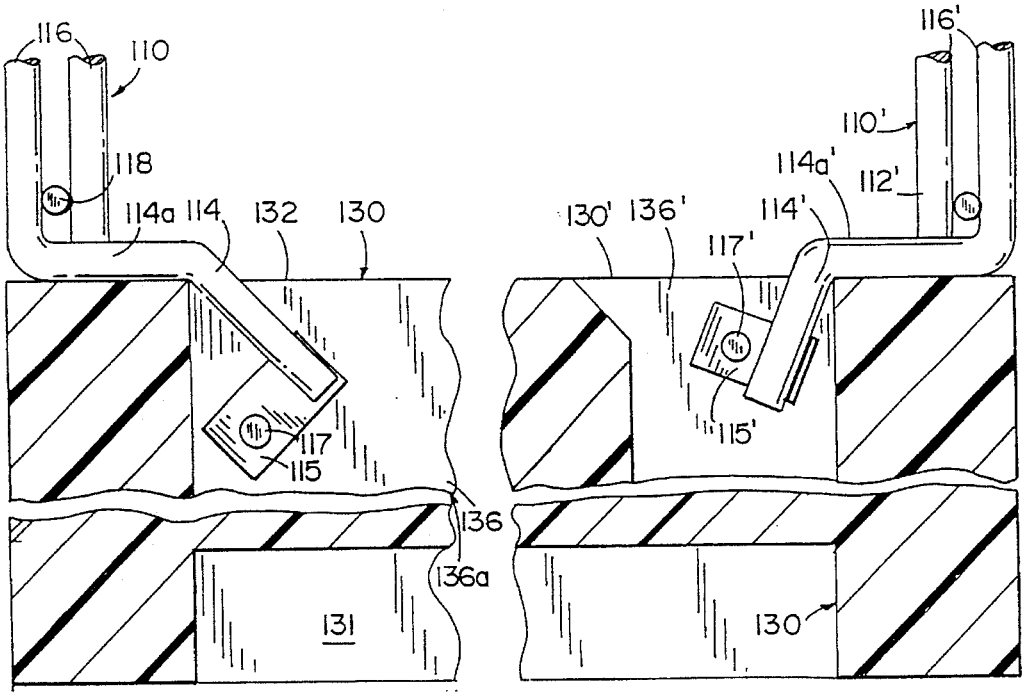
FIG. 6 is an enlarged, fragmentary, side elevational view of a second embodiment of this invention.
Figure 7:
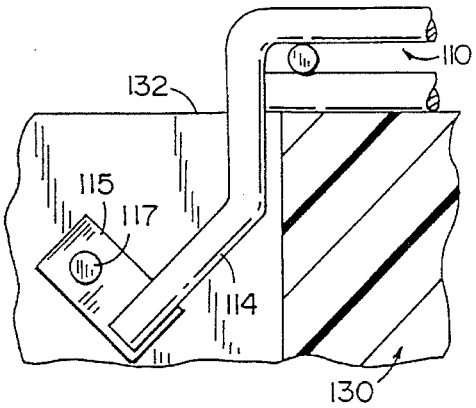
FIG. 7 is an elevational, fragmentary, side elevational view of the left portion of the apparatus in FIG. 6.
Figure 8:
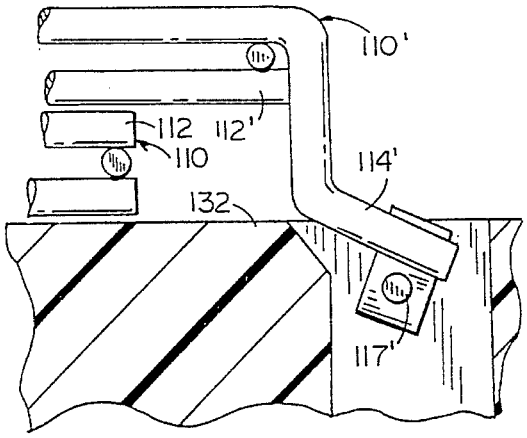
FIG. 8 is an enlarged, fragmentary, sectional, side elevational view of the right-hand portion of the second embodiment in FIG. 6.
Figure 9:
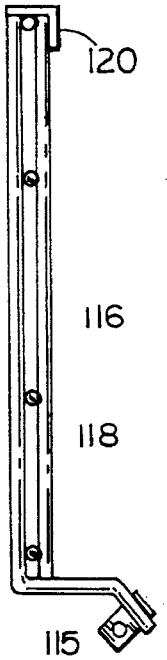
FIG. 9 is a side elevational view of the pallet guard in FIGS. 6–8.

Further, as explained relative to FIG. 6, the undersurface of each pallet can be hollow in the area where the lowered pallet guard on an underlying pallet would be positioned, such that the underlying guard would be received up into the hollow cavity in the underside of the overlying pallet. This arrangement enables stacked pallets with their respective guards to be returned in compact condition, with each pallet resting on the pallet therebeneath rather than on the guard.

Alternatively, upstanding ledges on the pallets projecting above the horizontal guards, in lieu of or in addition to the hollow pallet underside, would enable stacking engagement thereof in such a fashion that the horizontal guards are free of the load of the empty pallets.

Referring now to FIGS. 6–10, a second embodiment of the invention is there disclosed. More specifically, the pallet 130 shown in broken form has in combination therewith first and second pallet guards 110 and 110' at opposite ends of the pallet. The panel 112 of guard 110, and panel 112' of guard 110', are shown to have reinforced construction comparable to panel 12 of guard 10 of the first embodiment, i.e., having double vertical elements 116 straddling and welded to the horizontal elements 118. The panel is here shown to have three laterally spaced vertical elements, four horizontal elements and a reinforcing angle iron 120 across the top. This particular arrangement could be varied to suit the situation and product. The outer legs 116 of guard 110 are extended downwardly to depend therefrom in a manner to form a plurality of feet 114, here two, shown to project horizontally and then diagonally downwardly, for projecting into pockets 136 in pallet 130. At the lower terminal end of each foot 114 is a bracket 115 having a pin or bolt 117 extending transversely therethrough and securing the bracket to pallet 130 and specifically to a vertical wall **136*a* of pocket 136 of the pallet. The guard is pivotable about the two axially aligned pins 117 between the vertical upright operative position and the lowered horizontal storage position. The horizontal portion 114*a* of foot 114 has a lower surface which can rest against and abut the upper surface 132 of the pallet when the guard is upright. The pallet also has a bottom surface (not shown) in conventional fashion. The pivot pin 117 is mounted a predetermined distance below the top surface 132 of the pallet to enable panel 112 of guard 110 to lie flat against the pallet top surface and be parallel thereto, when pivoted to a horizontal storage position of the guard. Guard 110 can thus move between this horizontal position depicted in FIGS. 7 and 8, and the upright functional position depicted in FIG. 6 wherein further outward movement of the guard is prevented by the engagement of the bottom surface of horizontal portion of feet 114*a* of guard 110 against the upper surface 132 of pallet 130**.

Guard 110' is generally like guard 110, having the upstanding panel 112' formed of similar vertical and horizontal elements, and having a plurality of feet 114' which extend integrally down from the outer vertical rods 116', including a horizontal portion **114*a*' of the feet and a diagonal portion which is secured as by welding to brackets 115'. The brackets in turn are pivotally mounted by studs or pins 117' in the pockets 136' of pallet 130. The pivot points of pins 117' are, however, vertically offset upwardly an amount approximately equal to the thickness of panel 112. Guard 110' is also, therefore, pivotable about the axis of pins 117' from the functional vertical position illustrated in FIG. 6, to a horizontal storage position depicted in FIG. 8. As noted, panel 112' in its horizontal orientation is generally parallel to and spaced from upper surface 132 of pallet 130 an amount substantially equal to the thickness of panel 112 so that the two guards will overlap each other in the horizontal storage position, with one lying flat on the pallet top and the second lying flat on the first. Hence, when the pallet is employed to support a plurality of articles or canons filled with articles, the guards are upright, but prevented from moving outwardly past their vertical orientation by engagement thereof with the top surface of the pallet as depicted in FIG. 6, but can be folded downwardly toward each other in overlapping fashion to the compact storage condition for return shipment. As noted previously, the overlying pallet can be formed with a hollow underside as at 131 (FIG. 6**) so as to receive the folded guards of the underlying pallet assembly therein, enabling the overlying pallet to rest directly on the underlying pallet rather than on the guards themselves.

Figure 10:
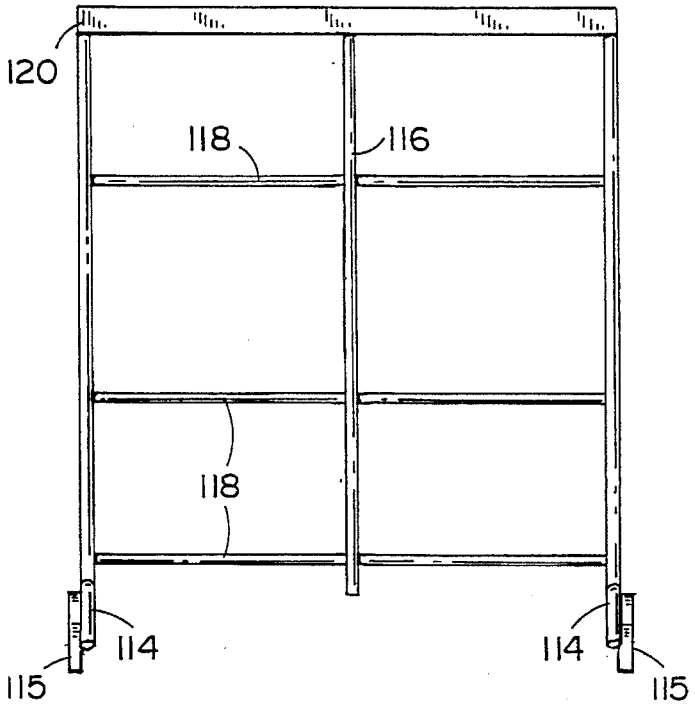
FIG. 10 is a front elevational view of the pallet guard in FIG. 9.

In FIG. 10, the guard is shown to have a plurality of two feet 114. However, the central rod 116 can be extended to form a third foot on this particular structure. The number of feet can be provided as desired, as well as the grid pattern or other structure employed to form panel 112, being modified to suit the particular type of article being stored and/or shipped.

Figure 11:
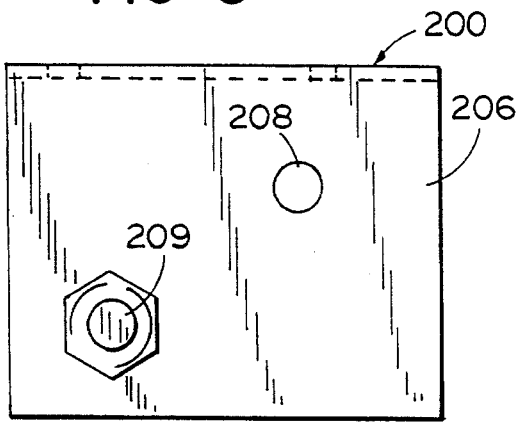
FIG. 11 is a side elevational view of a bracket usable with the pallet guard of FIGS. 9 and 10.
Figure 12:
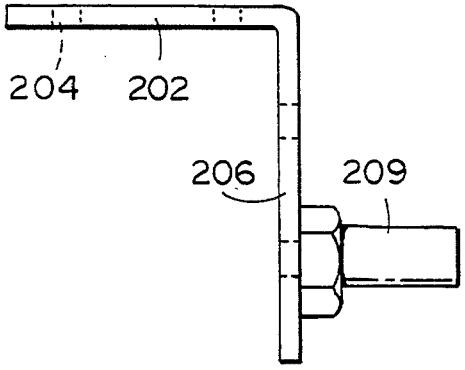
FIG. 12 is an end elevational view of the bracket in FIG. 11.
Figure 13:
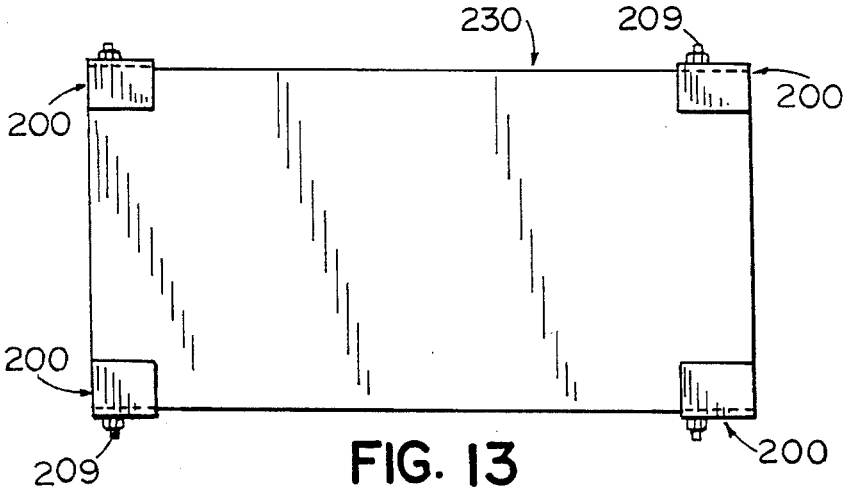
FIG. 13 is a top plan view of a pallet showing the brackets of FIGS. 11 and 12 mounted on the exterior of the pallet as a third embodiment of the invention.
Figure 14:
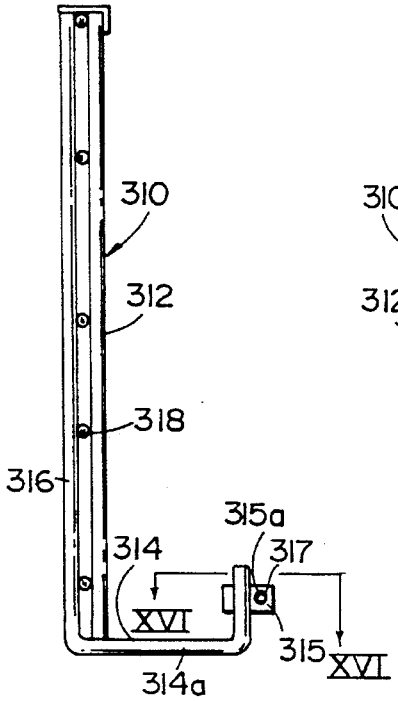
FIG. 14 is a side elevational view of a fourth embodiment of the pallet guard.
Figure 15:
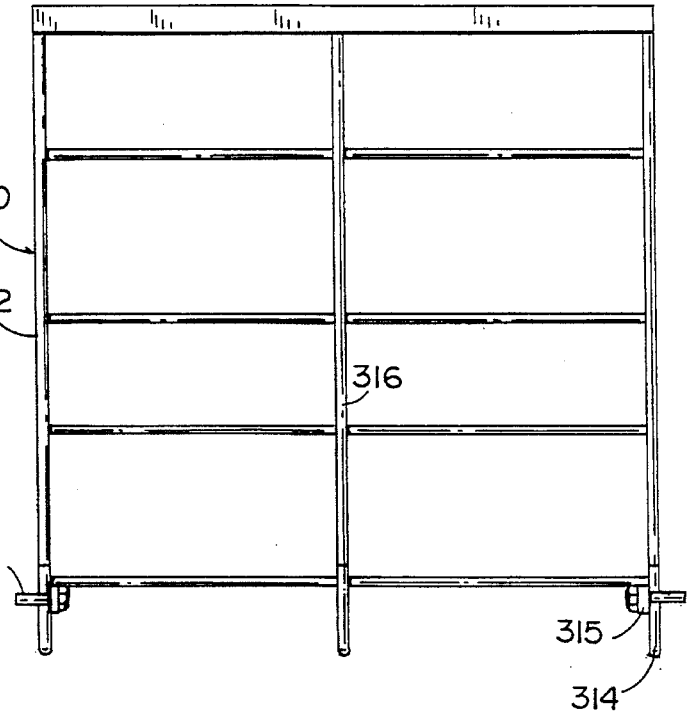
FIG. 15 is a front elevational view of the pallet guard in FIG. 14.
Figure 16:
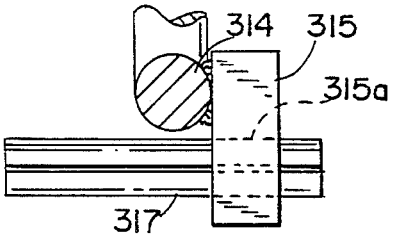
FIG. 16 is a fragmentary, enlarged, partially sectional view taken on plane XVI—XVI of FIG. 14.
Figure 17:
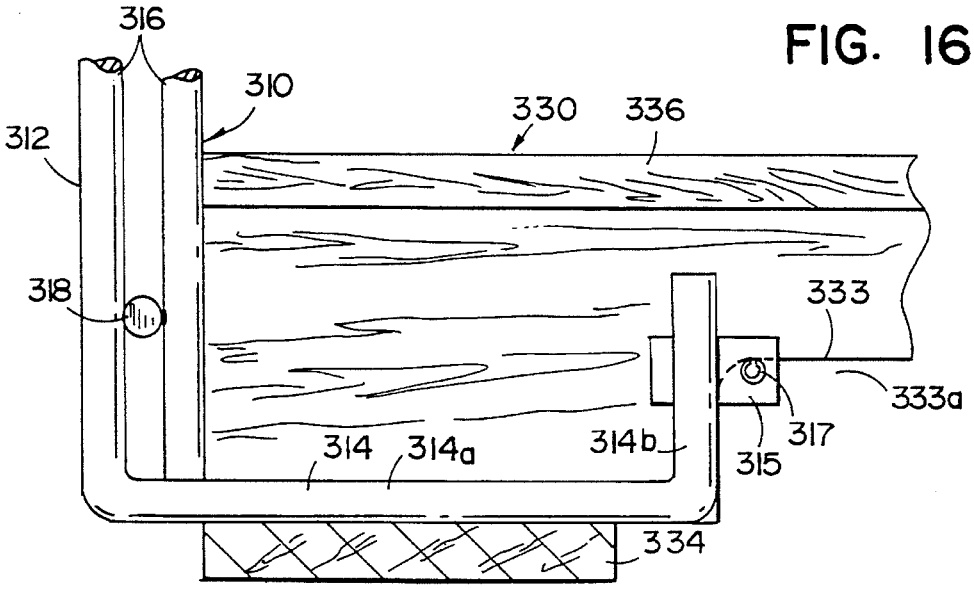
FIG. 17 is a fragmentary, enlarged, side elevational, partially sectional view of the pallet guard in FIGS. 14 and 15 as mounted on a wooden pallet.

Further, although the feet 114 and 114' are shown to extend into receiving recesses or openings or pockets of the pallet, they can be mounted on the exterior of the pallet using a structure such as that depicted in FIGS. 11–13.

In this third embodiment, the pallet 230 is shown to be elongated in configuration, having L-shaped brackets 200 mounted at its four comers. Each bracket is shown to have a horizontally extending flange 202 (FIG. 12) with openings 204 therethrough to receive fasteners for securing the brackets to the top of the pallet, and having vertical legs 206 with a pair of vertically and horizontally offset openings 208 to selectively mount pivot pins 209 in one or the other. More specifically, at one end of the pallet the pivot pins are mounted in the lower openings, e.g., as at the left end of the pallet in FIG. 13, while at the other end of the pallet the pivot pins are mounted in the upper openings, e.g., as shown at the fight end of FIG. 13. This vertical displacement enables the guards at opposite ends of the panel to fold down in overlapping relationship in the storage position.

In FIGS. 14–17 a fourth embodiment is depicted wherein guards 310, having panels 312 formed of vertical legs 316 and horizontal legs 318, include feet 314 which comprise extensions of legs 316. These feet include a horizontal leg portion **314*a* transverse to the panel and intended to cooperate with the transverse bottom board 334 of a wooden pallet 330. The feet project into the pallet in the conventional or typical space between the top and bottom boards. These feet also include a terminal leg 314*b* which extends vertically upwardly from the horizontal leg. A lateral bracket 315 is welded to leg 314*b*. This bracket has an opening 315*a* (FIG. 14) extending laterally between its faces to receive a roll pin 317 transverse to bracket 315 and leg 314*b*. This roll pin is to extend beneath and inwardly of the typical girder 333 of which three conventionally form a structural part of a wooden pallet. The girder includes laterally oriented, tine-receiving openings 333*a* to receive the tines of a conventional lift truck. Thus, in use, guard 310 is manually positioned with its feet 314 extending into the opening between bottom board 334 and top boards 336 of pallet 330, so that brackets 315 are adjacent the line-receiving slots 333*a* of girders 333 of the pallet, and then roll pins 317 are pressed or pounded through the openings in the brackets, one at each side of the pallet, to project into and abut the wall of slots 333*a* and prevent retraction of the guard until the roll pins are removed. These pins also prevent the guard from pivoting or tilting outwardly toward the adjacent end of the pallet. The guard is secured since inward faces of rods 316 thus abut against the top of the pallet, the bottom surfaces of feet 314 engage the bottom board 334 of the pallet, and the roll pins 317 engage the inside face of girder slots 333*a*. Hence, the guard resists outward movement of the vertical panel 312 by forces applied, to thereby restrain articles and/or packages on the pallet from falling off the end of the pallet. A like guard is placed in mirror image at the opposite end of the pallet, to thereby protect both the front and rear ends of the pallet from accidental discharge of the product being stored or shipped. As will be noted, this embodiment is not pivotable. Hence, when it is desired to stack the wooden pallets, guards 310 are removed from each pallet by knocking out the roll pins 317 from openings 315***a* and sliding out the guards from the pallet, returning the guards separately from the stacked pallets.

Figure 18:
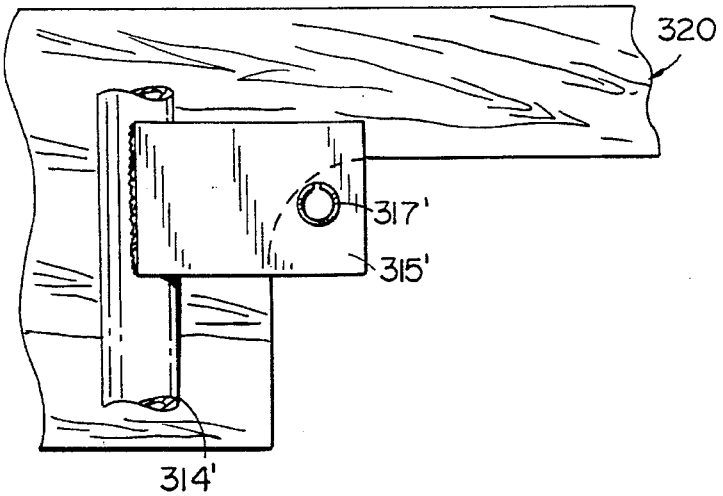
FIG. 18 is a fragmentary, enlarged, side elevational view of a variation of the pallet guard in FIGS. 14 and 15.
Figure 19:
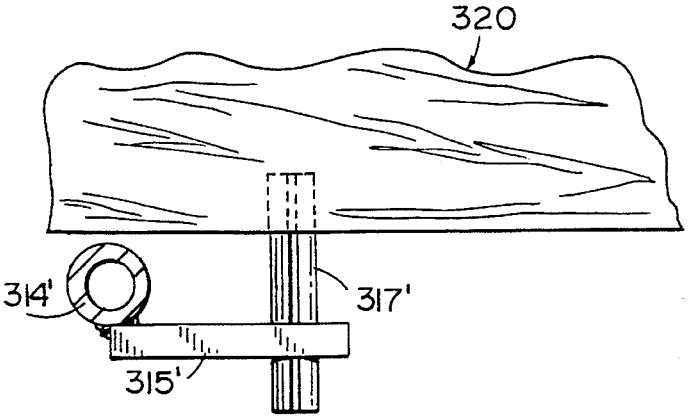
FIG. 19 is a top plan view of the variation in FIG. 18.

In FIGS. 18 and 19, a modified version of a fourth embodiment is depicted. Specifically, the brackets 315' are shown mounted outwardly of the vertical elements forming feet 314'. The roll pins 317' are employed in the same fashion as that just described. Instead of the elements forming the feet and forming the panel in this embodiment variation being solid rods, they can be tubular as depicted at 314'. This variation can be applied to any of the embodiments illustrated.

Figure 20:
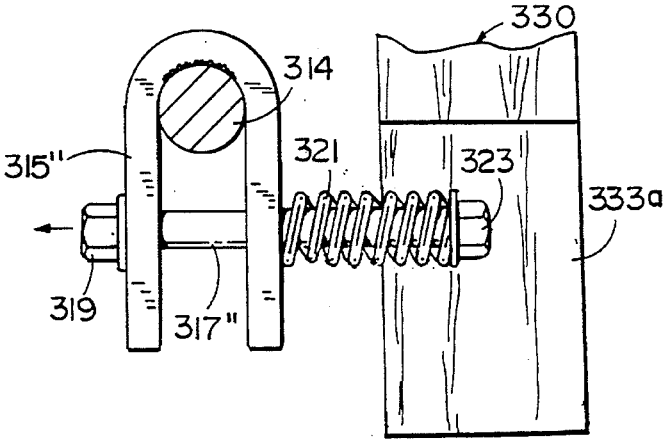
FIG. 20 is a second variation of the fourth embodiment.

In FIG. 20 is disclosed a second variation of the fourth embodiment wherein the bracket 315" attached to the feet 314 of the guards is U-shaped in configuration, extending around the foot 314 and being welded thereto. Extending through bracket 315", i.e., through both legs thereof, is a slide pin 317" having a nut 319 on one end, and a compression spring 321 and an additional retaining nut 323 on the opposite end. The opposite elongated end and compression spring extend into the tine-receiving slot 333*a* of the pallet 330, comparable to extension of roll pin 317' into slot 333*a* of pallet 330 in FIG. 17. The elongated pin 317" and coil spring retain the guard on the pallet. When it is decided to remove the guard from the pallet, the outer nut and end of the pin 317" are grasped and pulled manually to compress the spring 321. By doing this on both sides, a person can thereby release the guard on opposite sides of the pallet.

Therefore, the versions depicted in FIGS. 14–20 do not pivot to lie flat on the pallet, but rather the guards are easily removable from the pallet when it is desired to stack the pallets.

Figure 21:
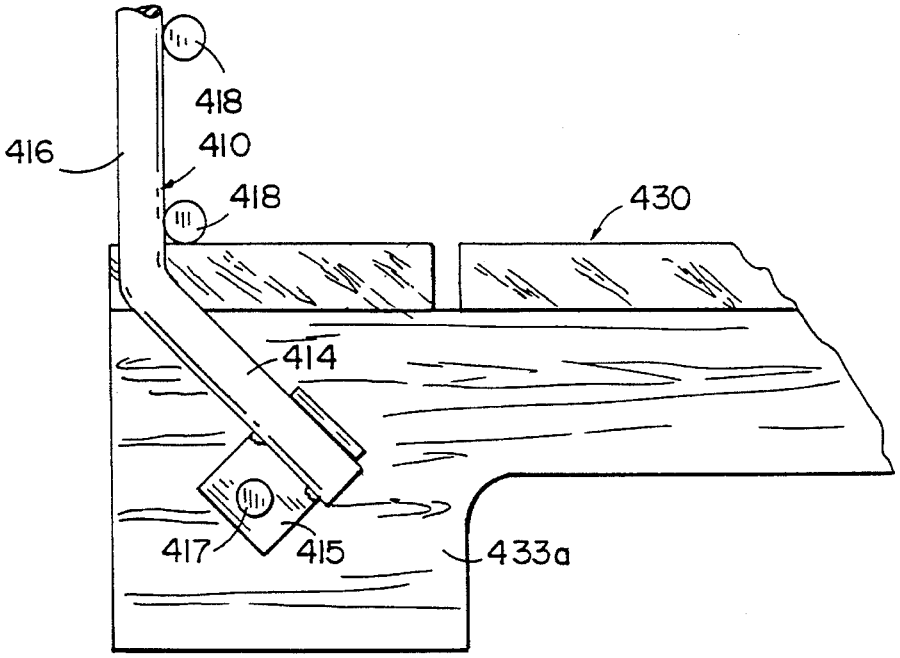
FIG. 21 is a fragmentary, side elevational view of a fifth embodiment pallet guard.

In FIG. 21, a guard 410 is shown mounted directly to girders of a wooden pallet. Guard 410 for wooden pallet 430 is shown in this instance to be a lighter weight guard, having only single vertical elements 416 combined with horizontal elements 418. The lower ends of vertical legs 416 extend diagonally downwardly-inwardly as feet 414 having brackets 415 on the lower ends thereof. Extending through openings in the brackets are transverse bolts 417 which attach the opposite ends of the guard to pallet 430, and specifically to girders 433*a*. The lowermost horizontal rod 418 abuts the top boards of pallet 430, to resist outward movement of the guard for restraining articles on the pallet. However, when the pallet is to be shipped, bolts 4 17 are pulled and the guard removed so that the pallets can be stacked in conventional fashion.

Figure 22:
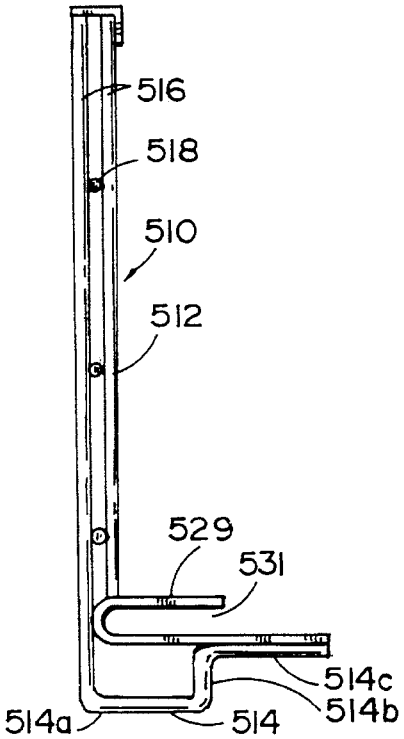
FIG. 22 is an end elevational view of a sixth embodiment.
Figure 23:
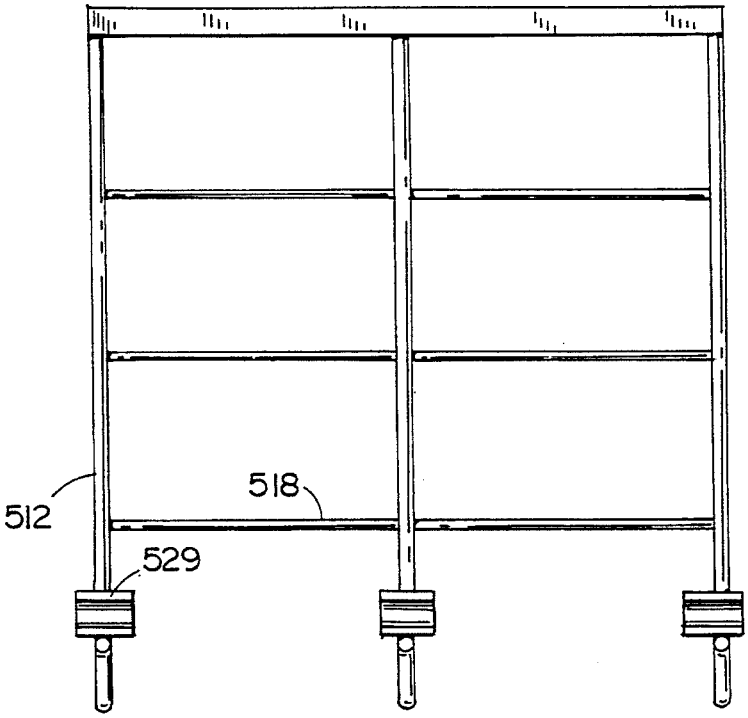
FIG. 23 is a front elevational view of the sixth embodiment in FIG. 22.

In FIGS. 22 and 23 is shown a sixth embodiment of the guard. This guard 510 includes an upstanding panel 512 here shown to be formed of heavy duty construction including pairs of parallel vertical members 516, astraddle of and welded to horizontal members 518, the combination forming a grid pattern panel. In this unit, the feet 514 have a first horizontal portion 514*a*, an upwardly extending portion 514*b*, and another horizontal portion 514*c*. Attached to the plurality of horizontal portions 514*c* are laterally oriented, U-shaped, elongated members 529 open toward the pallet to which the guard is to be mounted, and specifically toward the top board of the pallet. This plurality of U-shaped members form pockets 531 which receive the top and outermost board of a wooden pallet or the comparable part of a polymeric pallet. This embodiment is not pivotal relative to the pallet for storage. Further, it is not intended for heavy loads since such heavy loads, if applying outward force to the guard, could cause the upper board to which it is attached to be tom loose from the rest of the pallet. It is a relatively easy unit to install and remove, however, and is very suitable for light loads.

It is conceivable that certain additional variations could be made in the novel structure, the preferred embodiments of which are set forth herein as exemplary of the invention, yet without departing from the inventive concept. Any such variations are intended to be within the scope of the invention which is to be limited only by the scope of the appended claims and the reasonable equivalents to those defined therein, rather than to the illustrated exemplary embodiments set forth.

The embodiments of the invention in which an exclusive property or privilege is claimed are defined as follows.

1. A pallet guard to be secured to a pallet having upper and lower support surfaces, comprising:

an upright load restraining panel for extending upwardly of and normal to the pallet on at least one end of the pallet, said panel having a plurality of feet extending downwardly therefrom and spaced from each other to extend below the upper support surface of the pallet and engage the pallet below the upper support surface adjacent the one end of the pallet, said feet having pallet engagement portions positioned and configured to engage the upper support surface of the pallet and by such engagement below the upper support surface and at the upper support surface retain said panel upright against outward movement to restrain articles from falling off the pallet.

2. A pair of said pallet guards in claim 1 in mirror image to each other, for engagement with opposite ends of a pallet.

3. The pallet guard in claim 1 wherein said feet having securing connectors operable to secure said pallet guard to the one end of the pallet, and enable said panel to pivot thereabout to move between an upright functional position and a lowered storage position.

4. The pallet guard in claim 3 wherein said securing connectors comprise transverse pins on said feet.

5. The pallet guard in claim 4 wherein said feet have pins at alternative selected elevations to enable said panels on opposite ends of a pallet to be pivoted down into overlapping storage positions.

6. The pallet guard in claim 4 wherein said feet include brackets mounting said transverse pins.

7. The pallet guard in claim 4 wherein said pins have fastening means for fastening to a pallet.

8. A pallet guard to be secured to a pallet having upper and lower support surfaces, comprising:

an upright load restraining panel having a height for extending upwardly of and normal to the pallet on at least one end of the pallet, said panel having a plurality of feet extending therefrom and spaced from each other to extend below the upper support surface of the pallet and engage the pallet below the upper surface adjacent the one end of the pallet, said feet having a length only a fraction of said height of said panel so as not to project beyond the midpoint of the pallet, and having pallet engagement portions positioned and configured to engage the pallet and by such engagement retain said panel upright against outward movement to restrain articles from falling off the pallet, and said feet having securing connectors operable to secure said pallet guard to the one end of the pallet.

9. The pallet guard in claim 8 wherein said securing connectors comprise transverse pins on said feet, said transverse pins being retractable for removal of said pallet guard from a pallet.

10. The pallet guard in claim 9 wherein said feet include brackets mounting said transverse pins.

11. The pallet guard in claim 10 wherein said pins are roll pins.

12. The pallet guard in claim 10 wherein said pins are spring biased toward interengagement with a pallet, and retractable against the spring bias.

13. The pallet guard in claim 8 wherein said pallet interengagement elements comprise horizontal board-receiving slots on said feet to slidably fit over a top end board of a pallet.

14. The pallet guard in claim 13 wherein said slots are formed by U-shaped elements oriented normal to the inside face of a panel.

15. A pallet and pallet guard combination comprising:

a pallet having a pair of ends having upper and lower support surfaces, and having pockets formed therein and spaced from each other;

a pair of pallet guards, one on each of said ends of said pallet, each said pallet guard comprising an upright load restraining panel for extending upwardly of and normal to the pallet;

said panel having a plurality of feet extending therefrom and spaced from each other an amount to fit into said pockets, and being fitted into said pockets, and having pallet interengagement elements interengaging said pallet in said pockets in a manner to retain said panel upright against outward movement relative to said panel.

16. A pallet and pallet guard combination comprising:

a pallet having a pair of ends having upper and lower support surfaces, and having mounting surfaces formed therein and spaced from each other;

a pair of pallet guards, one on each of said ends of said pallet, each said pallet guard comprising an upright load restraining panel for extending upwardly of and normal to the pallet;

said panel having a plurality of feet extending therefrom and spaced from each other an amount to correspond to said mounting surfaces, and having pallet interengagement elements interengaging said mounting surfaces in a manner to retain said panel upright against outward movement relative to said panel.

17. The pallet and pallet guard combination in claim 15 wherein said interengagement elements comprise pivot brackets.

18. The pallet and pallet guard combination in claim 16 wherein said interengagement elements comprise pivot brackets.

19. The pallet and pallet guard combination in claim 16 wherein said pallet has spaced pockets, and said mounting surfaces are in said pockets.

20. The pallet and pallet guard combination in claim 16 wherein said mounting surfaces are on the exterior of said pallet.

21. The pallet and pallet guard combination in claim 15 wherein said pallet guards are pivotally movable to a storage position generally parallel to said pallet.

22. The pallet and pallet guard combination in claim 15 wherein said pair of pallet guards overlap each other in said storage position.

23. The pallet and pallet guard combination in claim 22 wherein said pallet guards are pivotally mounted to said pallet on vertically offset pivot axes to enable said overlap.

24. A pallet guard to be secured to a pallet having a pair of upper and lower support surfaces and having a plurality of openings in and normal to the upper support surface of the pallet at one or both ends of the pallet and having stop surfaces at these openings, said pallet guard comprising:

an upright restraining panel for extending upwardly of and normal to the pallet on at least one end of the pallet, said panel having a plurality of lower feet extending therefrom and spaced from each other, for projecting down into the plurality of openings in the pallet upper surface, said feet each having a lower support surface and having a projecting abutment surface for engaging the pallet stop surfaces, whereby said pallet guard will be retained in position to restrain articles from falling off the pallet.

25. The pallet guard in claim 24 wherein said feet are generally U-shaped in configuration, having a pair of spaced vertical legs and a bottom leg therebetween, one vertical leg of the U extending from said panel, said bottom leg of the U forming said lower support surface, and the other vertical leg of the U having an abutment surface comprising said projecting abutment surface.

26. The pallet guard in claim 25 wherein said panel comprises a plurality of rods attached to each other, said feet being extensions of at least some of said rods.

27. The pallet guard in claim 25 wherein said abutment surface is oriented upwardly to engage a downwardly oriented stop surface on the pallet.

28. The pallet guard in claim 25 wherein said bottom leg is longer than said other vertical leg.

29. A pallet and pallet guard assembly, said pallet having upper and lower support surfaces and a plurality of openings in and normal to said upper surface at at least one end of said pallet, having bottom support surfaces in said openings, and having upper stop surfaces at said openings, said pallet guard comprising an upright restraining panel for extending upwardly of and normal to said pallet on at least one end of said pallet, said panel having a plurality of lower feet depending therefrom and laterally spaced from each other, projecting down into said plurality of openings in said pallet upper surface, said feet each having a lower support surface and having a projecting abutment surface for engaging said pallet stop surfaces.

30. The pallet and pallet guard assembly in claim 29 wherein said openings are at both ends of said pallet, and including a pair of pallet guards, one at each end of said pallet, each said pallet guard comprising an upright restraining panel extending upwardly of and normal to the pallet on one end of the pallet, each said panel having a plurality of lower feet depending therefrom and laterally spaced from each other, projecting down into said plurality of openings in the pallet upper surface.

31. The pallet and pallet guard assembly in claim 29 wherein said openings have bottom support surfaces, said feet engage said support surfaces, said abutment surfaces are oriented upwardly, said stop surfaces are oriented downwardly, and said abutment surfaces engage said stop surfaces.

32. The pallet and pallet guard assembly in claim 29 wherein said openings have bottom support surfaces and said feet engage said support surfaces.

33. The pallet and pallet guard assembly in claim 29 wherein said feet are generally U-shaped in configuration, having a pair of spaced vertical legs and a bottom leg therebetween, one vertical leg extending from said panel and the other vertical leg forming said abutment surface, said bottom leg having a length greater than the length of said openings in the same dimension, and said other vertical leg having a length less than said length of said openings in the same dimension.

* * * * *

UNITED STATES PATENT AND TRADEMARK OFFICE

CERTIFICATE OF CORRECTION

PATENT NO. : 5,465,812

DATED : November 14, 1995

INVENTOR(S) : Jay C. Petter

It is certified that error appears in the above-indentified patent and that said Letters Patent is hereby corrected as shown below:

Column 5, Line 63;
"canons" should be – cartons –;

Column 6, Line 31;
"fight" should be – right –;

Column 6, Line 54;
"line-receiving" should be – tine-receiving –;

Column 7, Line 52
"bolts 4 17" should be – bolts 417 –;

Column 8, Line 6;
"tom" should be – torn –.

Signed and Sealed this

Thirteenth Day of August, 1996

*Attest:*

Bruce Lehman

BRUCE LEHMAN

*Attesting Officer*

*Commissioner of Patents and Trademarks*